United States Patent [19]

Olson

[11] Patent Number: 4,582,258

[45] Date of Patent: Apr. 15, 1986

[54] TWO-PIECE LOW VOLUME SPRAY DEVICE

[76] Inventor: Donald O. Olson, 1636 Dartmouth St., Chula Vista, Calif. 92010

[21] Appl. No.: 492,508

[22] Filed: May 9, 1983

[51] Int. Cl.[3] ..... B05B 1/26

[52] U.S. Cl. ..... 239/498

[58] Field of Search ..... 239/498, 518, 524, 542, 239/500, 547

[56] References Cited

U.S. PATENT DOCUMENTS

| | | | |
|---|---|---|---|
| 1,674,480 | 6/1928 | Nelson | 239/498 |
| 2,697,008 | 12/1954 | Rowley | 239/498 |
| 2,724,614 | 11/1955 | Rider | 239/498 |
| 3,815,831 | 6/1974 | Jooste | 239/498 |
| 4,199,105 | 4/1980 | Olson et al. | 239/498 |

*Primary Examiner*—Andres Kashnikow
*Assistant Examiner*—Daniel R. Edelbrock
*Attorney, Agent, or Firm*—Owen, Wickersham & Erickson

[57] ABSTRACT

An improved low volume spray device for an irrigation system comprises upper and lower separately molded plastic members that may be assembled before or after the lower member is installed on a fluid conduit. The lower member, which is secured within the conduit, is molded with a conical deflector portion that receives the main force of the liquid stream from the conduit. An upper head member snaps onto the lower member and has a peripheral series of spaced apart teeth adapted to receive liquid from the conical deflector and separate it to form a uniform spray pattern of radially directed streams. Since the main fluid force is on the conical deflector, fluid pressure cannot act to separate the upper member when in use.

2 Claims, 8 Drawing Figures

TWO-PIECE LOW VOLUME SPRAY DEVICE

BACKGROUND OF THE INVENTION this invention relates to an improved low volume spray or sprinkler device for producing a uniform spray pattern when used with surface irrigation systems and more particularly to one comprised of two separate components that are easily assembled but will not separate inadvertently when in use due to fluid pressure in the system.

For certain crops, trees or plants, surface irrigation systems utilizing a large number of small sprinkler devices are highly effective because they can be located close to the plant and will dispense only a small amount of water in an efficient pattern. Often, in typical irrigation systems, hundreds or thousands of such sprinkler devices are required and they must be attached to conduits extending from water supply heads usually made of plastic material. Heretofore, those in the prior art have strived to perfect a sprinkler device that was inexpensive to manufacture, easy to install and reliable in the field. In U.S. Pat. No. 3,815,831, a spray device comprised of two molded plastic members was disclosed. However, in actual practice, it was found that after weathering in the field the upper cap member tended to blow off or become separated from the lower member due to fluid pressure. A one-piece spray device, as shown in U.S. Pat. No. 4,199,105, was devised to overcome this problem but it failed to provide a spray pattern that was completely satisfactory for some applications.

In my copending application Ser. No. 06/243,723, filed Mar. 16, 1981, now U.S. Pat. No. 4,401,273, an improved two-piece spray device which also solved the blow off problem was disclosed wherein an upper head member utilized an integral lower portion secured within the conduit and was also connected to a lower plug portion. However, again the spray pattern produced by this device was unsatisfactory for some applications.

It is, therefore, a general object of the invention to provide an improved low volume spray device for surface type irrigation systems.

Another object of the invention is to provide an improved two-piece low volume spray device comprised of a lower member adapted to be secured in a fluid carrying conduit to provide an outlet for fluid therefrom and having a deflector that receives substantially the full force of the fluid stream from the conduit, and an upper cap member that can be snap fastened to the lower member which provides peripheral spaced apart notches that form a uniform radially directed spray pattern.

Still another object of the invention is to provide a low volume two-piece spray device that is easily attached to a supply conduit either fully assembled or by its lower member, and moreover, a device wherein the deflector portion which receives the force of the fluid stream is integral with the lower member, so that no force is exerted to inadvertently blow off or separate the upper member.

Yet another object of the invention is to provide a low volume, two-piece spray device that is particularly well adapted for ease and economy of manufacture.

BRIEF SUMMARY OF THE INVENTION

The aforesaid objectives are accomplished by an improved low volume spray device according to the principles of the present invention which comprises a lower main body element and a top cap element which when assembled together can be readily inserted into a side wall of a flexible conduit forming part of a surface type irrigation system. The lower element has an intermediate body portion with a downwardly extending shank having a series of external threads and a beveled tip at its lower end. Attached to and extending above the body portion is a pair of spaced apart posts that support a fixed fluid deflector member having a smooth conical surface. The upper or top cap member is shaped so as to snap fasten onto the deflector member at the top of the posts. Around the periphery of the top cap is a series of downwardly extending tooth-like projections that form circumferentially spaced openings between them. These openings are located near the outer edge of the deflector member so that water flowing radially from its impact point at the apex of the deflector is broken up into radially directed substreams by the projections and openings of the top cap. Thus, a uniform spray pattern is formed by the sprinkler, and yet, since the force of the water from the conduit is against the deflector which is part of the lower member, there is no fluid force tending to "blow off" the top cap. As a result, the improved spray or sprinkler device will provide efficient, reliable operation for long periods.

Other objects, advantages and features of the invention will become apparent from the following detailed description of one embodiment thereof presented in conjunction with the accompanying drawing.

DETAILED DESCRIPTION OF EMBODIMENT

Figure 1:
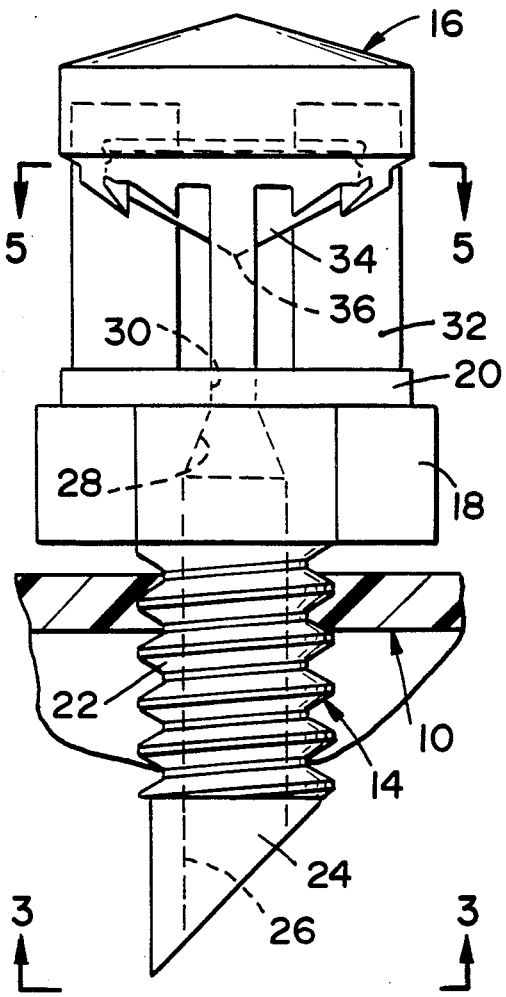
FIG. 1 is a view in elevation of an assembled two-piece sprinkler device according to the present invention.

Referring to the drawing, FIG. 1 shows a two-piece spray or sprinkler device 10 according to the invention as it appears when assembled and installed in a flexible plastic bore or conduit 12 of a typical surface type irrigation system. In such a system, water is supplied at a constant pressure to the conduit and is forced through the device to produce a desired spray pattern adjacent a tree or plant being irrigated. The spray devices are relatively small and normally dispense water at a low rate (e.g., 1.0 to 1.5 gals/hr). A typical irrigation system may utilize several conduits of considerable length connected to a main supply conduit, with many such spray devices spaced apart along them, in order to irrigate a large area and a large number of plants and/or trees.

In general, the spray device 10 is comprised of a main or lower body member 14 and an upper cap member 16. Both of these components are made separately of a suitable molded plastic material (e.g., nylon, polyvinylchloride), and then are assembled together, preferably before the device is attached to a conduit.

The lower body member has an enlarged intermediate portion 18 with a preferably cylindrical upper end 20, directly below which it has a flat sided or hexagonal shape to facilitate turning when installed. Extending downwardly from this portion 18 is a threaded shank 22 the lower end of which is a cylindrical tip portion 24. This tip portion is beveled to provide a taper with a sharp edge for initially penetrating the wall of a conduit. Through the tip portion, the shank, and the intermediate portion, is a coaxial bore 26 that has a larger diameter (e.g., 0.156 inches) at its lower end and extends through the threaded shank to a converging section 28 and another bore 30 with a smaller diameter (e.g., 0.021 to 0.063) at its upper end, thereby increasing the force and velocity of the water that exits from the bore. The device may be made with smaller bores 30 of different diameters in order to provide spray devices with different spray pattern characteristics.

Integral with the cylindrical upper end of the intermediate portion and extending upwardly from its surface is a pair of post members 32 which are spaced 180 degrees apart. In cross section these post members are wedge shaped and taper inwardly to a knife edge that lies on a plane through the center line of the intermediate portion and the centrally located exit port 30 thereon. Supported by and integral with the post members 32 is a deflector member 34 having a conical surface whose apex 36 is coincident with the center line axis of the intermediate portion 18 and its exit port 30.

Figure 2:
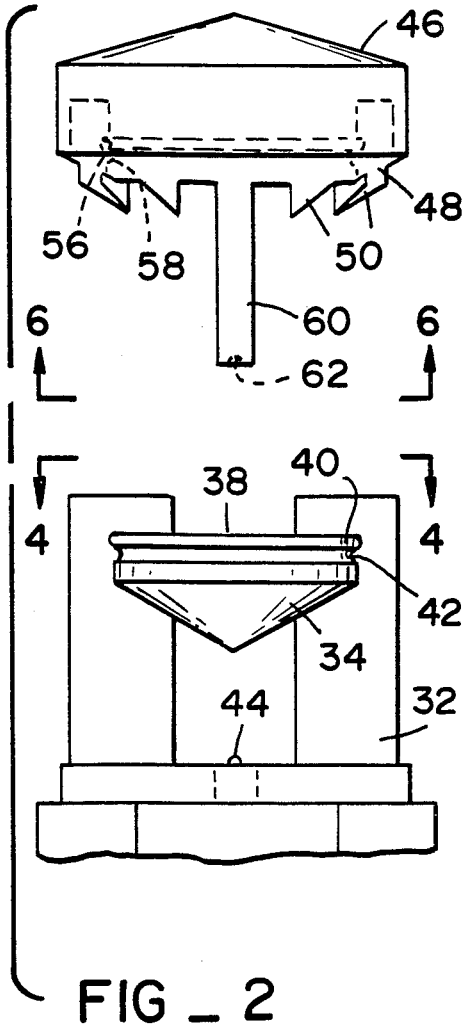
FIG. 2 is an exploded view in elevation of the sprinkler device of FIG. 1 showing the upper and lower elements separated.
Figure 3:
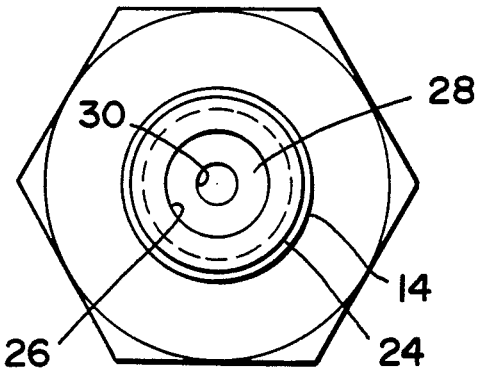
FIG. 3 is a bottom view of the sprinkler device taken along line 3—3 of FIG. 1.
Figure 4:
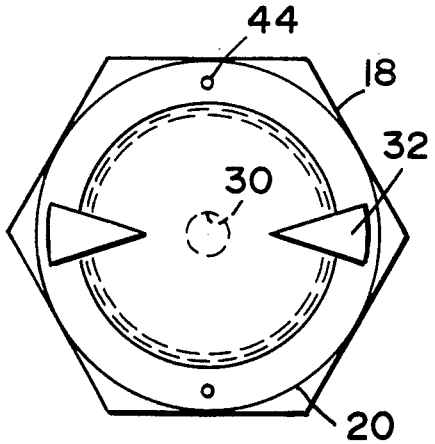
FIG. 4 is a top view of the lower element of the device taken along line 4—4 of FIG. 2.

As shown in FIG. 2, the diameter of the conical shaped deflector member is such that its outer edge terminates substantially at the middle of the side surfaces of the post members 32. The upper surface 38 of the deflector member is spaced downwardly from the upper ends of the post members so that end portions thereof project above it. Around the upper surface is a lip member 40 with a rounded edge and directly below it is a groove 42 with a rounded surface having substantially the same radius as the rounded edge.

As stated, the post members are located 180 degrees apart on the surface of the cylindrical upper end of the intermediate body portion 18. Precisely half way between the two post members on a circumferential line nearer the outer edge thereof is a pair of button like protuberances 44 which extend above the surface of the upper cylindrical end of the intermediate body portion. These protuberances are used to help retain the cap member on the lower member, as will be explained in greater detail below.

Figure 5:
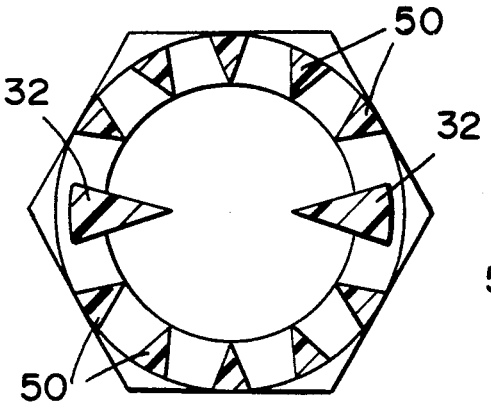
FIG. 5 is a view in section taken along line 5—5 of FIG. 1.
Figure 6:
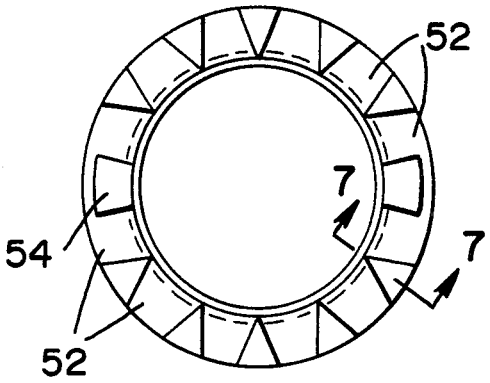
FIG. 6 is a bottom view of the upper element taken along line 6—6 of FIG. 2.
Figure 7:
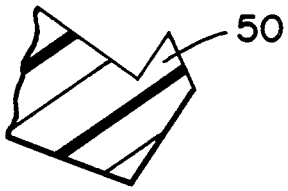
FIG. 7 is a fragmentary view in section taken along line 7—7 of FIG. 6.

Now, as readily seen in FIG. 2, the upper cap member 16 is a separate element which is connectable to the lower member. As shown, it has a generally cylindrical shape with a conical upper surface 46. Extending below the main cylindrical body is an annular skirt portion 48 that is castellated to form a series of tooth like projections 50 on its lower edge. These latter projections, as seen in FIGS. 5 and 6, are located around the outer portion of the cap member to form circumferentially evenly spaced apart notches or passages 52 for directing the water into radial streams as the water leaves the conical surface of the deflector. In cross section, each projection is wedged shaped and tapers inwardly to a knife edge located near the outer periphery of the conical deflector surface. Spaced 180 degrees apart in the same outer portion of the cap member is a pair of recesses 54 having a cross sectional shape and a proper location to receive the projecting upper end portions of the post members (see FIG. 6).

Figure 8:
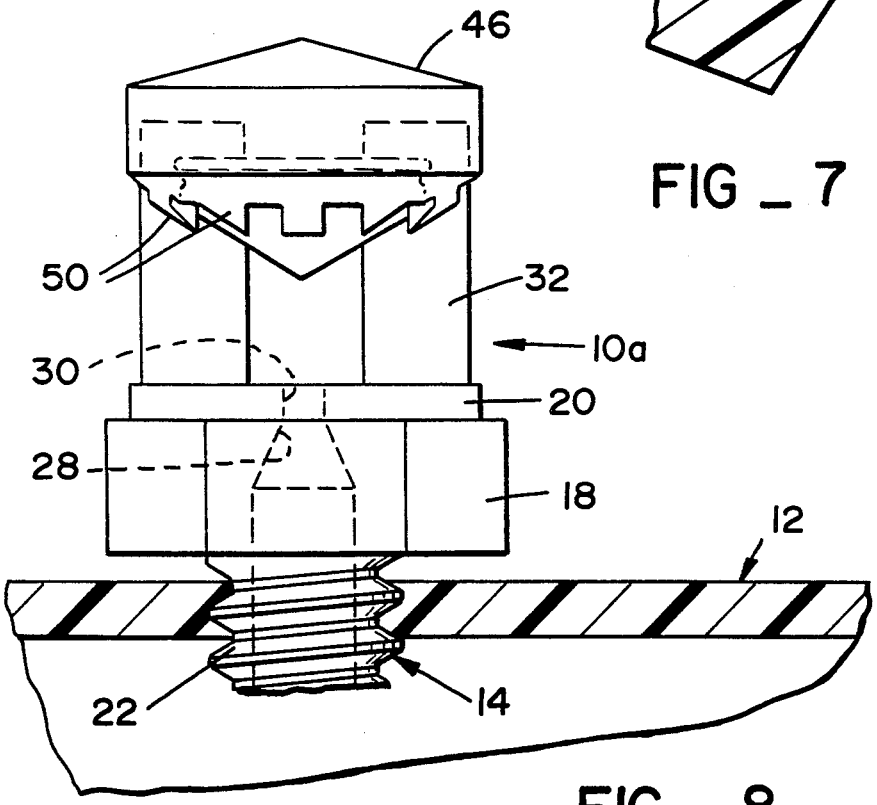
FIG. 8 is a fragmentary view in elevation showing a slightly modified form of sprinkler device according to the present invention as it appears when installed in the side wall of a conduit.

Within the generally circular recess formed by the annular skirt portion 48, as shown in FIG. 2, is a groove 56 located just above an annular internal lip member 58. When the lower body member and the cap member are assembled, the upper end portions of the post members fit into the recesses 54 and the peripheral lip member 40 of the deflector fits within the matching groove 56 on the interior of the cap member. As the cap member is pressed onto the lower member, the deflector lip 40 interferes slightly with the interior lip 58 adjacent the interior groove, and some compression of the two lips occurs as the two parts snap into proper engagement. When fully seated, the deflector lip 58 of the cap member 16 is in the groove 42 on the deflector 34. Simultaneously, a gain of intermediate legs 60 on the cap member extend downwardly to engage the upper surface of the lower member. Each protuberance 44 on the upper surface snaps with an interference fit with a matching recess 62 in the bottom of an intermediate leg. These intermediate legs may not be required for all versions of the device 10, but they provide added assembly stability and strength when required. FIG. 8 shows such a modified device **10*a*** without intermediate legs.

When assembled as described, by a simple compression force, the combined cap member 16 and lower body member 14 can be quickly installed in the wall of a plastic conduit. With a moderate amount of force, the sharpened lower end 24 of the shank member can penetrate the conduit wall and with a few turns the threads on the shank portion 22 will be firmly attached. As water flows through the main bore 26 and the constricted bore 30 to increase velocity, its force is directly against the conical deflector. From this deflector, the water flows radially through the spray forming openings 52 of the cap member. Since the deflector, which receives the force of the water stream, is part of the lower member, there is no force tending to blow off the cap member. Thus, the spray device will have reliability and long life when in actual use in the field.

To those skilled in the art to which this invention relates, many changes in construction and widely differing embodiments and applications of the invention will suggest themselves without departing from the spirit and scope of the invention. The disclosures and the description herein are purely illustrative and are not intended to be in any sense limiting.

It is claimed:

1. A spray device adaptable for connection with a conduit supplied with fluid under pressure comprising:

a lower member having a main body portion with downwardly extending means for connecting said device to a conduit, upwardly extending post means and a central passage extending therethrough to allow liquid to flow from said conduit through an inlet in said downwardly extending means and an outlet in said main body portion;

a deflector member spaced above said main body portion and attached to said post means for receiving the force of and for deflecting radially the fluid from said opening;

a separate cap member having an annular portion with radial grooves for forming a relatively uniform spray pattern from the radially directed fluid from said deflector; and means on said cap member for removably attaching it to said deflector member and said lower member and comprising a pair of downwardly extending leg members spaced 180 degrees apart with a small recess in the bottom of each leg member, and a pair of protuberances on the upper surface of said main body portion, each protuberance being adapted to form an interference fit with a said recess when the lower member and cap member are assembled together;

whereby the main force of fluid under pressure which flows through said central passage, strikes and deflector member and does not act to remove said spray forming cap member from said lower member during operation of the device.

2. The spray device as described in claim 1 wherein said means for attaching said cap member to said lower member further includes an interior annular deflector lip member on said cap member which interferes with a slightly larger peripheral lip member on the outer edge of said deflector member and fits within a groove adjacent said larger lip member on said deflector member when said cap member is attached.

* * * * *

UNITED STATES PATENT AND TRADEMARK OFFICE

CERTIFICATE OF CORRECTION

PATENT NO. : 4,582,258

DATED : April 15, 1986

INVENTOR(S) : Donald O. Olson

It is certified that error appears in the above-identified patent and that said Letters Patent are hereby corrected as shown below:

Column 6, line 4, "and" should read --said--.

Signed and Sealed this

*Twenty-second* Day of *July 1986*

[SEAL]

*Attest:*

DONALD J. QUIGG

*Attesting Officer*

*Commissioner of Patents and Trademarks*